US005983507A

United States Patent [19]

Hirai

[11] Patent Number: 5,983,507

[45] Date of Patent: Nov. 16, 1999

[54] SINTERED TITANIUM CUTLERY HAVING ANTIBIOTIC ACTIVITY

[76] Inventor: Akira Hirai, No. 19 3-19, 1-chome, Sakae-cho, Kawaguchi, Saitama-ken, Japan

[21] Appl. No.: 09/065,960

[22] Filed: Apr. 24, 1998

[30] Foreign Application Priority Data

Apr. 25, 1997 [JP] Japan ..... 9-142877

[51] Int. Cl.[6] ..... B26B 9/00

[52] U.S. Cl. ..... 30/350; 76/104.1; 419/6

[58] Field of Search ..... 76/104.1; 30/358, 30/357; 419/6, 7, 9; 428/550

[56] References Cited

U.S. PATENT DOCUMENTS 3,411,208 11/1968 Maim ..... 30/350

4,212,669 7/1980 Veeck et al. ..... 419/6

*Primary Examiner*—M. Rachuba

*Attorney, Agent, or Firm*—Morrison Law Firm

[57] ABSTRACT

A cutting tool is formed as a sintered body which is made by sintering a mixture of materials at a temperature of below 1500° C. in vacuum or in a rare gas. The mixture of materials consists of titanium powder or titanium alloy powder for a first material, titanium carbide for a second material, and silver powder for a third material. The proportion of the second material to the first material is 5–50 weight %, The proportion of the third material to the total amount of the first and second materials is 0.1–10 weight %. The hardness of the sintered body is preferably more than HRC 35°. Cutlery produced from the sintered material has a remarkable antibiotic activity together with excellent sharpness and durability of the blade edge.

11 Claims, No Drawings

SINTERED TITANIUM CUTLERY HAVING ANTIBIOTIC ACTIVITY

BACKGROUND OF THE INVENTION

This invention relates to cutlery principally for cooking use such as a kitchen knife, a petit knife, or cooking scissors and the like, each having antibiotic activity. This invention also relates to cutlery composed mainly of a sintered body of titanium. This invention relates further to means for imparting antibiotic properties to cutlery composed mainly of titanium.

Owing to disgraceful incidents of mass poisoning from mishandling of food in school cafeterias, a great interest in sanitary food handling has arisen. At the same time, research into providing antibiotic properties to tableware and various kinds of cooking tools have become very active. Particularly, kitchen cutlery for cooking such as kitchen knives, paring knives, scissors for cooking and the like are indispensable for cutting edibles such as root crops, leaf crops, meat, fish or the like. Because most cutlery for cooking today is made of stainless steel, research for cutlery of stainless steel containing an amount of copper is practiced. This is because stainless steel itself has no antibiotic properties. However stainless steel cutlery containing copper provides copper ions from the cutlery body during cutting. The copper ions enter the water contained in the edibles being cut. The copper ions show an antibiotic action. Also, it is known that silver ions also possess antibiotic properties.

OBJECTS AND SUMMARY OF THE INVENTION

Accordingly, it is an object of the present invention to provide cutlery, having an antibiotic property, composed mainly of titanium. Because titanium has a high melting temperature and low malleability, no cutlery for cooking such as kitchen knives or paring knives can substantially be produced by conventional forming processes normally used for making stainless steel cutlery. According to the present invention, cutlery is produced by a sintering process.

Briefly stated, the present invention provides a cutting tool formed as a sintered body made by sintering a mixture of materials at a temperature of below 1500° C. in vacuum or in a rare gas. The mixture of materials consists of titanium powder or titanium alloy powder for a first material, titanium carbide for a second material, and silver powder for a third material. The proportion of the second material to the first material is 5–50 weight %, The proportion of the third material to the total amount of the first and second materials is 0.1–10 weight %. The hardness of the sintered body is preferably more than HRC 35°. Cutlery produced from the sintered material has a remarkable antibiotic activity together with excellent sharpness and durability of the blade edge.

According to an embodiment of the invention, there is provided a cutlery material comprising: a sintered body, the sintered body including, before sintering, a first material of a titanium alloy powder, a second material of a titanium carbide powder, and a third material of a silver powder, the second material being present in a proportion of 5 to 50 weight percent of the first material, the third material being present in a proportion of 0.1 to 10 percent of a total of the first and second materials, and the sintered body having a hardness of HRC 350.

According to a feature of the invention, there is provided a method for forming a utensil, comprising: adding from 5 to 50 weight percent of a titanium carbide powder to one of a titanium powder and a titanium alloy powder, to produce a first mixture, adding from about 0.1 to about 10 weight percent of a silver powder to the first mixture to produce a material mixture, charging the material mixture into a mold having a negative shape of the utensil, compressing the material mixture in the mold to form a molded body, and sintering the molded body in an inert atmosphere at a temperature below about 1500 ° C. for a time sufficient to accomplish sintering.

According to a further feature of the invention, there is provided a sintered titanium cutting tool having antibiotic activity, comprising: a tool body, the tool body being an edged sintered body produced by means of compressing a material powder mixture set in a mold under pressure of 1–15 ton/cm$^2$ so as to form a molded body, and heated in an inert atmosphere at a temperature of below 1500 ° C., the material powder mixture being composed of at least one of a titanium powder and a titanium alloy powder for a first material, titanium carbide powder for a second material, and silver powder for a third material, an amount of the second material is 5–50 weight % of the first material, an amount of the third material is 0.1–10 weight % of a total amount of the first and second materials, and a hardness of the sintered body is more than HRC 35°.

More specifically, according to this invention, silver is included for its antibiotic properties while maintaining the properties necessary for normal cutlery use. The principal problems to be solved in this invention are to provide antibiotic sintered cutlery by finding:

1) Sintering temperatures which are necessary and sufficient.
2) Proportions of materials required for providing cutlery for cooking having suitable sharpness and tenacity and no brittleness in use.

A first aspect of the invention relates to materials from which cutlery can be made. That is, the first material is titanium powder or titanium alloy powder. The titanium alloy powder may be for instance, titanium 90%, aluminum 6%, and vanadium 4%. Various other kinds of titanium alloy has been known, and most can be applied. The second material is a titanium carbide powder. The third material is a silver powder.

The second aspect of this invention relates to means for treating the above-noted three kinds of materials to form a sintered body. The working steps are as follows:

1) The above-noted powder materials are mixed.
2) The powder mixture is charged into a mold having a shape suitable to form the desired tool for cooking.
3) The powder mixture is compressed in the mold.
4) The powder mixture is sintered in vacuum, or in an inert gas such as argon or other rare gas at a temperature below 1500° C. for sintering.
5) Then, the sintered body is removed for cooling at room temperatures.
6) Finally the sintered body is edged by conventional grinding and polishing operations.

The third aspect of this invention relates to the mixing rate of the first to third materials. The second material must be present in an amount of 5–50 weight % of the first material components. The third material must be present in an amount of 0.1–10 weight % of the total amount of the first and second materials. The hardness of the sintered body is above HRC 35°.

According to a fourth aspect of the invention the first to third materials and hardness of the sintered body are closely related to one another.

The silver powder, which is the third material, is 0.1–10.0 weight % of the total amount of the first and second materials. A proportion of silver powder of less than 0.1% does not provide a substantial antibiotic property to a cutting tool. When the proportion of silver powder exceeds about 10%, although antibiotic action of the cutlery is satisfactory, it is not possible to attain a hardness of the sintered body of more than HRC 35°. As a result, the desired sharpness of the blade cannot be obtained.

According to the invention, the proportion of titanium carbide, which is the second material, against the first material should be 5–50 %. The lower limit of 5% established by the fact that lower amounts of titanium carbide in the titanium alloy give excessively low hardness to the sintered body. The value 5 is the lowest value of density in the sintered body which will give the sufficient hardness required for the edge of the cutting blade. The upper limit is 50% is established by the fact that, although higher values improve the hardness of the sintered body, such higher values increase brittleness of the blade edge, especially noticeable during edging operations on the cutting blade.

According to this invention, the above-noted powder mixture charged in a mold is compressed and molded. The molded body is then sintered at a high temperature. The sintering temperature should not be above 1500 ° C. A sintering temperature over 1500° C. causes degeneration of the silver. The degeneration of the silver reduces antibiotic action caused by silver ions being lost from the cutlery blade. However the value of pressure upon molding operation may not be strict. A molded body having a particularly smooth skin is obtained at a pressure of 1–15 ton/cm.

According to this invention, a cutting tool can have an antibiotic effect on human hands, edible materials, and other cooking tools which touch the cooking tool in the course of cutting the edible materials. This occurs because silver particles causing the antibiotic action of the cutting tool spread uniformly in the cutlery body. Such an antibiotic action of the cutlery is not lost in the course of manufacturing the cutlery. The antibiotic activity of a cutting tool according to this invention is present in all parts of the cutlery body. This is an improvement over a utensil having only a surface treatment giving it antibiotic properties. In the present cutlery, since the antibiotic substance is within the entire sintered body, the antibiotic-activity does not decline with washing and wear of the cutlery. On the contrary, the antibiotic activity is extremely long lasting.

It is a benefit of the sintering process that the sintered body is much more porous than is true of a forged stainless steel material. This porosity provides a much larger surface area, including within the interstices of the sintered body, from which silver ions may be provided to food material being cut.

As mentioned in the foregoing, a cutting tool according to this invention provides long-lasting antibiotic action over an extended period of use. It is an advantage of the present invention that the antibiotic action is attained while retaining the sharpness of the blade that is required primarily for a cutting tool. That is, according to this invention, as noted in the foregoing, it has been discovered that the proportions of powder materials of titanium or titanium alloy against titanium carbide can be kept within a certain scope and, at the same time, the hardness of the cutlery can be kept at more than HRC 35°. And also, according to this invention, because the tenacity of the cutting blade retained, many kinds of cutlery for cooking which are sharp and resist chipping and are light in weight can be provided.

The above, and other objects, features and advantages of the present invention will become apparent from the following description.

DETAILED DESCRIPTION OF THE PREFERRED EMBODIMENTS

EXAMPLE 1

Five g of titanium carbide powder having a particle diameter below 10 $\mu$m is added to 100 g of titanium alloy powder composed of titanium 90%, aluminum 6%, and vanadium 4%. The titanium alloy powder has a particle diameter less than 100 $\mu$m. An amount of 0.1 g of silver powder, having a particle diameter less than 10 $\mu$m is added to the above mixture and mixed sufficiently to form a material mixture. The material mixture is charged in a mold for a kitchen knife having a shape of a plate which consists of a blade plate portion and a shank portion extending from the blade plate portion as a single body, The material mixture charged in the mold is compressed under a pressure of 10 ton/cm$^2$ so as to obtain a molded body. The molded body is put in a vacuum furnace and heated at a temperature of 1250° C. for about three hours so as to obtain a sintered body. The sintered body, after cooling is edged by means of grinding and polishing operations along a portion which corresponds to the blade edge of a kitchen knife. The kitchen knife thus obtained has a very sharp blade edge due to its hardness of about HRC 45° . This kitchen knife thus obtained resists chipping during use for cutting normal edibles such as vegetables, meat, fish or the like. This kitchen knife shows no abnormal appearance when dropped from a point about one meter high. And, this kitchen knife in use, shows satisfactory antibiotic action due to the availability of silver ions.

EXAMPLE 2

Fifty g of titanium carbide powder having a particle diameter of about 1 $\mu$m together with 10 g of silver powder having a particle diameter of less than 10 $\mu$m is added to 100 g of titanium powder having a particle diameter of less than 100 $\mu$m. This composition is mixed well prepare a material mixture. The material mixture Is molded. The mold is for one arm of a pair of scissors for cooking having a pair of arms pivoted to each other at about a middle portion of each the arm. Each arm has a slender and edged blade and a shank portion extending from the blade with a finger bore so that an edible can be cut by a pair of the blade edges. The aforementioned powder of material mixture is molded under pressure at a condition as noted in embodiment 1 to obtain an arm for the pair of scissors. A pair of the molded bodies are heated for about two hours at a temperature of 1500° C. in an argon gas furnace to produce a pair of sintered bodies. Each of the sintered bodies thus obtained is then edged at a portion for the blade. The pair of arms are pivoted to each other so as to form a pair of scissors. A pair of scissors for cooking thus obtained has a hardness of HRC 50° which is sufficient for retaining sharpness. This pair of scissors is under no risk of chipping while cutting edibles or from dropping onto the floor. Also a very strong antibiotic capacity is present because of the amount of silver contained therein.

One skilled in the art will recognize that the titanium alloy powder of example 1 and the titanium powder of example 2 may be replaced by a mixture of titanium powder and titanium alloy powder without departing from the spirit and scope of the invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cutlery material comprising:

a sintered body;

said sintered body including, before sintering, a first material of at least one of a titanium powder and a titanium alloy powder, a second material of a titanium carbide powder, and a third material of a silver powder;

said second material being present in a proportion of 5 to 50 weight percent of said first material;

said third material being present in a proportion of 0.1 to 10 percent of a total of said first and second materials; and said sintered body having a hardness of at least HRC 35°.

2. A sintered body according to claim 1, wherein said sintered body is in the shape of a knife.

3. A sintered body according to claim 1, wherein said sintered body is in the shape of at least part of a pair of scissors.

4. A method for forming a utensil, comprising:

adding from 5 to 50 weight percent of a titanium carbide powder to one of a titanium powder and a titanium alloy powder, to produce a first mixture;

adding from about 0.1 to about 10 weight percent of a silver powder to said first mixture to produce a material mixture;

charging said material mixture into a mold having a negative shape of said utensil;

compressing said material mixture in said mold to form a molded body; and sintering said molded body in an inert atmosphere at a temperature below about 1500° C. for a time sufficient to accomplish sintering.

5. A method according to claim 4, wherein the step of compressing includes compressing at a pressure of from about 1 to about 50 tons/cm$^2$.

6. A method according to claim 4, wherein said time is about 2 hours.

7. A method according to claim 4, wherein said inert atmosphere includes at least one of a vacuum, a rare gas, or argon gas.

8. A method according to claim 4, wherein the proportion of said titanium carbide powder to said titanium powder is sufficient to produce a hardness of at least HRC 35°.

9. A sintered titanium cutting tool having antibiotic activity, comprising:

a tool body;

said tool body being an edged sintered body produced by means of compressing a material powder mixture set in a mold under pressure of 1–15 ton/cm$^2$ so as to form a molded body, and heated in an inert atmosphere at a temperature of below 1500° C.;

said material powder mixture being composed of at least one of a titanium powder and a titanium alloy powder for a first material, a titanium carbide powder for a second material, and a silver powder for a third material;

an amount of said second material is 5–50 weight % of said first material;

an amount of said third material is 0.1–10 weight % of a total amount of said first and second materials; and a hardness of said sintered body is at least HRC 35°.

10. A sintered titanium cutting tool according to claim 9, wherein said cutting tool is a knife for use for cooking, having an edged blade and a shank integrally extending from said body.

11. A sintered titanium cutting tool according to claim 9, wherein said tool is a pair of scissors for use for cooking having a pair of arms, each having an edged blade and a shank having a finger bore and extending integrally from said blade, said pair of arms being pivoted with each other, each at an end portion of its respective blade near said shank so as to shear edible materials put between said pair of blades.

* * * * *